US006043444A

United States Patent [19]

Nutt et al.

[11] Patent Number: 6,043,444

[45] Date of Patent: Mar. 28, 2000

[54] MICROWAVE SENSOR FOR SORTING LEAN MUSCLE

[75] Inventors: S. Fred Nutt, Oregon; Larry C. Gundlach, Madison; William T. Paulos, McFarland; Andrew Milkowski, Madison, all of Wis.

[73] Assignee: Kraft Foods, Inc., Northfield, Ill.

[21] Appl. No.: 08/801,596

[22] Filed: Feb. 13, 1997

[51] Int. Cl.[7] ..... B07C 5/00

[52] U.S. Cl. ..... 209/576; 209/2; 209/559; 209/588; 436/21; 436/154; 436/177; 324/637

[58] Field of Search ..... 209/576, 2, 559, 209/588, 587; 250/250, 910; 426/231, 232; 436/21, 154, 171; 324/637, 639, 640, 601

[56] References Cited

U.S. PATENT DOCUMENTS

| | | | |
|---|---|---|---|
| 2,954,811 | 10/1960 | Hensgen et al. . | |
| 2,992,332 | 7/1961 | Madigan . | |
| 3,877,818 | 4/1975 | Button et al. | 250/910 X |
| 4,168,431 | 9/1979 | Henriksen . | |
| 4,171,164 | 10/1979 | Groves et al. . | |
| 4,263,098 | 4/1981 | Kasperek et al. | 250/910 X |
| 4,266,425 | 5/1981 | Allport . | |
| 4,359,638 | 11/1982 | Allport . | |
| 4,384,206 | 5/1983 | Bjarno . | |
| 4,404,642 | 9/1983 | Rosenthal | 250/910 X |
| 4,415,809 | 11/1983 | Shields | 250/910 X |
| 4,484,133 | 11/1984 | Riggin | 324/640 X |
| 4,504,963 | 3/1985 | Johnson . | |
| 4,590,377 | 5/1986 | Lukens . | |
| 4,674,325 | 6/1987 | Kiyobe et al. | 324/640 X |
| 4,788,853 | 12/1988 | Bell | 324/640 X |
| 4,847,794 | 7/1989 | Hrubes . | |
| 5,215,772 | 6/1993 | Roth | 426/231 |
| 5,229,726 | 7/1993 | Kent | 324/640 X |
| 5,247,460 | 9/1993 | Labudde . | |
| 5,260,576 | 11/1993 | Sommer, Jr. et al. . | |
| 5,331,284 | 7/1994 | Jean et al. | 324/639 |
| 5,382,444 | 1/1995 | Roehrig et al. | 426/646 |
| 5,403,747 | 4/1995 | Akins, Jr. et al. | 436/86 |
| 5,470,595 | 11/1995 | Kopp et al. | 426/231 |
| 5,485,082 | 1/1996 | Wisspeintner et al. . | |
| 5,648,038 | 7/1997 | Fathi et al. | 324/639 X |
| 5,845,529 | 12/1998 | Moshe et al. | 324/640 X |

OTHER PUBLICATIONS

Guided Microwave Spectrometry Measurement of the Moisture Content and Other Variables in Liquids, Granular Solids, and two or three phase flowable mixtures; 3–Series Guided Microwave Spectrometer, Feb. 1994, 4 pages.

*Primary Examiner*—Dean J. Kramer
*Assistant Examiner*—Steven B. McAllister
*Attorney, Agent, or Firm*—Cook, Alex, McFarron Manzo, Cummings & Mehler, Ltd.

[57] ABSTRACT

Apparatus and method are provided for temperature calibration of a microwave sensor unit used in non-destructively measuring and monitoring meat parameters such as fat, protein, and moisture content of a meat supply presented into the sensor unit. The apparatus implementing the method provides for separating the portion of the meat supply exceeding a maximum allowable meat parameter. The method provides for temperature calibration of the microwave sensor unit by processing microwave signal and temperature measurements of meat samples in combination with laboratory analysis data of the same meat samples to obtain temperature-corrected value of meat parameter measurements of the supply of meat presented into the sensor unit.

5 Claims, 3 Drawing Sheets

MICROWAVE SENSOR FOR SORTING LEAN MUSCLE

FIELD OF THE INVENTION

This invention generally relates to measuring and monitoring meat parameters of a flowing lean meat supply utilizing a microwave sensor. More particularly, the invention relates to a method and an apparatus for improving a microwave sensor in order to achieve a more accurate measuring and monitoring of the meat fat content of a flowing supply of lean meat, even including lean muscle meat, and separating any portion of the meat flow which exceeds a maximum allowable fat content limit, irrespective of temperature variations within the environment of a meat processing plant.

BACKGROUND OF THE INVENTION

The level of fat included in diets is of concern in many channels, particularly with respect to meat products or foods which contain animal-originating meat components. Meat food products are available which fall into the generally low-fat category. In the past, it has been considered to be satisfactory if the fat content of an uncooked raw meat supply is within a general magnitude on the order of about 10 weight percent or even 5 weight percent. While fat percentages of this general magnitude for raw meat materials represent a substantial step toward reducing the intake of fat for those who consume products made from this reduced-fat raw material, it would be beneficial to provide a highly functional fat-reduced meat raw material having a much lower fat content.

Awareness of fat intake has led consumers to value highly those food sources which are relatively low in fat or have virtually no fat content. Traditionally, many meat products have been perceived by certain groups as being products that are relatively high in fat content. Various techniques have made available meat products having fat percentages of 5% or less, such as at the 1% to 4% by weight level of fat in the meat product. Examples are turkey breast products which can achieve fat levels at the lower values of these ranges.

Consumer perception has developed along these lines to the extent that there is a desire to have even these relatively low fat percentages reduced further, ideally to arrive at a fat-free condition or a nominally fat-free condition. For example, current guidelines which are followed by the USDA permit many packaged meat products to be labeled as "fat-free" provided the amount of fat in the packaged meat product is less than 0.5 gram of fat per nutritional "references amount" of grams per serving of the meat product. This translates to a weight percent which can vary depending upon the particular meat products. For example, for a sliced meat or sausage product, the reference amount is 55 grams, and the amount of fat allowable in this type of fat-free product is less than 0.91% by weight of the total packaged meat product. Such a product is thus properly designated as "free" of fat, and nutritional labelling properly specifies a zero ("0") as the reported fat content.

Accordingly, there is an important need for meat products having a fat content which meets these zero, or nominal zero levels. Recently, different approaches have been used or proposed which are capable of providing raw lean meat supplies which have fat values low enough to be incorporated into the production of products which meet these fat-free criteria.

One type of approach in this regard involves grinding and centrifuging to provide a flow of reduced-fat meat without substantial denaturation thereof. Included are the approaches of Roehrig et al. U.S. Pat. No. 5,382,444, of U.S. patent application Ser. No. 08/694,146, filed Aug. 8, 1996, and of their related applications, incorporated hereinto by reference.

Another approach for providing raw lean muscle supplies processes whole muscle sections so as to provide a flow of muscle core meat cuts of especially lean attributes. This procedure includes separating the raw muscle supplies along cut lines to collect the most desirable naturally occurring muscles. This trimming type of approach is described in U.S. patent application Ser. No. 08/510,993, filed Aug. 3, 1995, incorporated hereinto by reference.

A further approach incorporates sinew removal in its fat reduction approach. It is described in U.S. patent application Ser. No. 08/740,135, filed Oct. 22, 1996, incorporated hereinto by reference. This approach recognizes that many fat removal or dilution procedures fail to remove sinew from the meat and therefore fail to address disadvantages attendant to the presence of sinew, including toughness, chewiness, and/or the presence of fat cells associated with or attached to sinew. As used herein, the term sinew refers to gristle and other connective tissues which are naturally incorporated with muscle tissue. This sinew is generally intimately interwoven with the muscle tissue. Fatty deposits are associated with and attached to the intimately interspersed sinew, which is typically not susceptible to removal by hand trimming, for example. This approach recognizes that the removal of a significant and substantial portion of sinew without grinding the meat is an important objective.

Even with these approaches for providing supplies of raw lean meat, it is still important to check that the meat supplies have fat percentages as low as required in order to be certain that the fat-free meats being produced always adhere to the governmental definition. However sophisticated these processes are, it is still the case that meat processing is subject to numerous sources of variation, not found in other industries, making the problem of product consistency quite difficult. Raw meat trimmings are sold to meat processors based upon the fat content, and incoming lots are routinely analyzed by the meat processor to check for the supplier's contractual compliance. Thus, the raw material input to any of these processes can vary, leaving open the possibility of at least a portion of that variation affecting the output from the particular process used in preparing raw lean meat for fat free production. Accordingly, there is a need for ongoing monitoring of fat content of these raw lean meat supplies. One possible option could be chemical analysis of sampled lots for moisture, fat and protein. Such chemical analysis testing is an invasive testing procedure that can be time consuming and inefficient and cannot test an entire meat flow.

In contrast, testing may be performed in a noninvasive manner through the use of microwave sensors. These provide a valuable improvement in monitoring meat flows. However, heretofore microwave sensors have not been required to monitor very low-fat raw lean meat supplies. It has been discovered that such microwave sensor equipment typically is not adequate to consistently monitor these very low-fat meat supplies. More particularly, it has been discovered that the sensitivity of this equipment to temperature variations renders it unreliable for a very low fat application.

The present invention addresses this problem by providing an inventive method and apparatus for calibrating microwave sensors for measurement of meat fat, protein, and moisture content and further separating portions of the meat that exceed the standard fat, protein, and moisture content. Temperature calibrating according to the invention alleviates a persistent erroneous measurement problem which developed in attempting to use available equipment for measuring very low levels of meat parameters.

SUMMARY OF THE INVENTION

The present invention provides for more accurately measuring the fat, protein, and moisture content of a flowing meat supply using a temperature calibrated microwave sensor. A microwave sensor is calibrated to compensate for inaccuracies in fat, protein, and moisture content measurements caused by temperature variations in the meat processing environment. The present invention utilizes microwave signal readings and laboratory analysis data to provide a set of calibration coefficients to be used by the microwave sensor in order to provide a temperature corrected output. Furthermore, the temperature corrected output measurement is compared to an upper limit value such as the maximum allowable fat content, wherein the meat portions that exceed such value can be separated for further reprocessing.

It is a general object of this invention to provide for a highly accurate measurement of meat parameters such as fat, protein, and moisture.

Another object of the present invention is to provide a temperature calibrated microwave sensor for monitoring a flowing supply of meat and removing from the flow any meat which deviates from a meat parameter norm.

Another object of this invention is to provide an improved method and apparatus which detects very slight variations from a very low fat content requirement.

Another object of the present invention is to account for temperature sensitivity of a microwave sensor monitor, which sensitivity would otherwise unacceptably render inaccurate the reported value of a meat parameter.

In accordance with these and other objectives, the present invention provides a method of separating meat products into multiple flows, at least one flow having a meat parameter in excess of a predetermined amount, comprising the steps of: providing a microwave sensor unit having a location at which microwave power is applied; flowing a supply of meat through the microwave sensor unit; applying microwave power of the microwave sensor unit to the flowing supply of meat to generate microwave signal readings of the meat products; sensing the temperature of the flowing supply of meat to generate a temperature signal reading; transmitting the microwave signal readings and the temperature signal reading to a processor of the microwave sensor unit; processing the microwave signal readings and the temperature signal reading together with a preloaded set of temperature calibration coefficients in order to generate temperature corrected meat parameter value outputs for the microwave sensor unit for variations in temperature of the flowing supply of meat; comparing the meat parameter derived during the processing step with a predetermined meat parameter value; and diverting from the flowing supply of meat a portion thereof which had been determined during the processing step to have a meat parameter in excess of said predetermined amount.

BRIEF DESCRIPTION OF THE DRAWINGS

In the course of this description, reference will be made to the attached drawings, wherein.

DETAILED DESCRIPTION OF THE INVENTION

Figure 1:
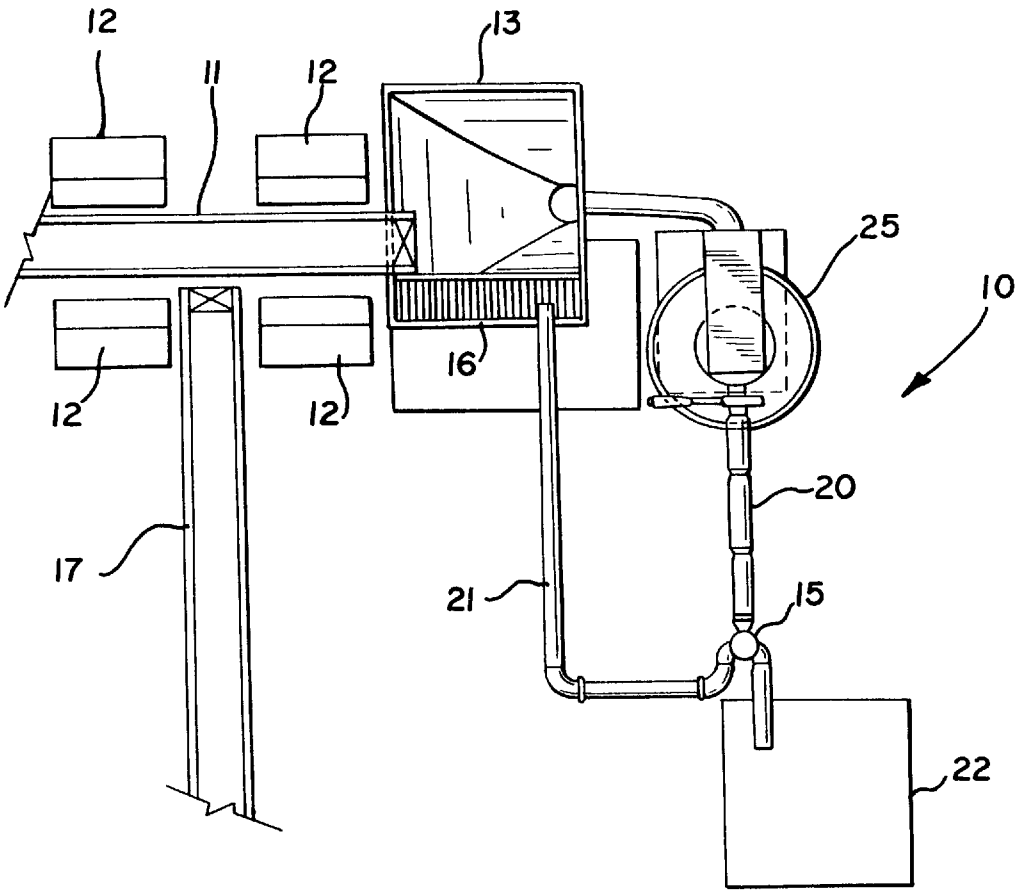
FIG. 1 is a plan view of a preferred embodiment of the apparatus of the present invention installed at the output of a meat processing production line.

Referring now to FIG. 1, there is shown an overall view of an embodiment of the present invention including a temperature calibrated microwave sensor unit 10. In a preferred embodiment, the present invention is implemented using an Epsilon 3-Series Guided Microwave Spectrometer (GMS), modified as disclosed herein. The Epsilon GMS system is a microwave system that determines the fat, protein, and moisture content of meat or poultry as the product passes through the guided microwave pipeline sensor.

In accordance with the invention, a continuous supply of very low-fat lean meat is supplied into a hopper 13. Although, the modified GMS unit 10 of the present invention is used in the measurement and monitoring of a continuous supply of very low-fat lean meat, it can also be utilized in a batch processing application. In either situation, the lean meat supply can be from processing equipment as discussed herein, such as the grinding and centrifuging approach, the disinewing approach and/or the trimming approach. The meat supply could also be very low fat supplies such as those originating from mechanically deboned turkey and the like. FIG. 1 illustrates a portion of the trimming approach. Untrimmed meat is transported on a conveyor belt 17 from which it is received by individuals standing by and transferred onto a series of trimming stations 12. Trimming operations are performed on the untrimmed meat and the resulting trimmed very low-fat meat is placed on a conveyor belt 11. The trimmed, very low-fat meat is transported on the conveyor belt 11 and transferred onto the hopper 13.

Figure 2:
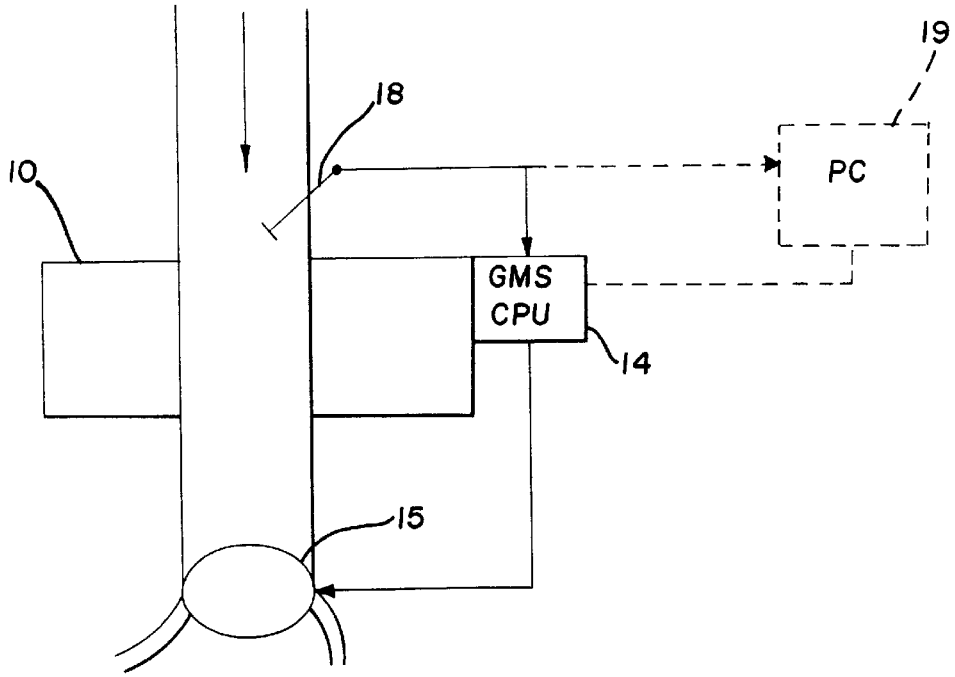
FIG. 2 illustrates the apparatus of the present invention utilizing a personal computer for static temperature calibration.

This trimmed very low-fat meat is then fed to the modified GMS unit 10, with the use of pump 25, for the measurement of one or more of certain meat parameters such as fat, moisture, and protein content. For ease of discussion, fat monitoring is focused upon herein. Thus, the measured fat content of the meat is compared to a preloaded upper limit value stored in the central processing unit (CPU) 14 of the GMS unit 10. (See FIG. 2). In the illustrated embodiment, this upper limit value for the purpose of a fat-free meat processing application is set at 1.5% by weight; however, it can be set at a different value depending on the lean meat inflow and the finished product requirements. In the event that the measured fat content exceeds 1.4%, a diverter valve 15 will be actuated for separating that portion of the meat exceeding the fat content upper limit and returning the same for further reprocessing.

In the event that some portion of the subject meat is separated and returned for reprocessing, it will be transferred to a rework operation. In the illustrated embodiment, a trimming station 16 receives same where further trimming is performed thereon by individuals standing by. The high fat by-products produced from the trimming are then asided for other uses, whereas the further trimmed portion of the meat is placed on conveyor belt 11 to be fed back in the GMS unit 10 for remeasurement of its fat content. Alternatively, the meat on the trimming station 16 can be combined with another meat source to attempt to achieve the target low fat percent.

In order to accurately measure the above-mentioned meat parameters such as fat content, the GMS unit 10 must be calibrated for temperature variations present in the meat processing environment. It has been determined that measurements of GMS sensors are adversely affected by temperature changes. This is believed to be the case primarily because the microwave signals measure changes in the dielectric constants of the water content of the meat flow. Since the dielectric constant of water changes with changes in the temperature, a change in temperature would change the microwave measurements, producing erroneous results. The present invention recognizes the importance of providing for corrections in the measurements made by an unmodified GMS unit in order to compensate for such temperature changes by calibrating the GMS unit 10. The effects of temperature changes have been noted to be unacceptable when the meat parameter such as fat is very low. In this regard, a low-magnitude error due to temperature value variation is much more disruptive of accuracy when the fat percentage is also low level, resulting in a percentage error which is so large as to render the fat reading unreliable.

The temperature in the supply of meat is measured by a Resistive Thermocouple Device RTD 18 that is preferably positioned upstream from the GMS unit 10. (See FIG. 2) It is also possible to position the RTD 18 downstream or even within the GMS unit 10 itself. Alternatively, the temperature used can be that of the meat supply as it flows within fat reduction equipment, such as that of said U.S. Pat. No. 5,382,444. The RTD Sensor or other temperature source supplies temperature values to the GMS CPU 14. During a static calibration mode, temperature values are also provided to a personal computer (PC) 19 for calibration purposes of the GMS unit 10 as will be discussed below.

Figure 4:
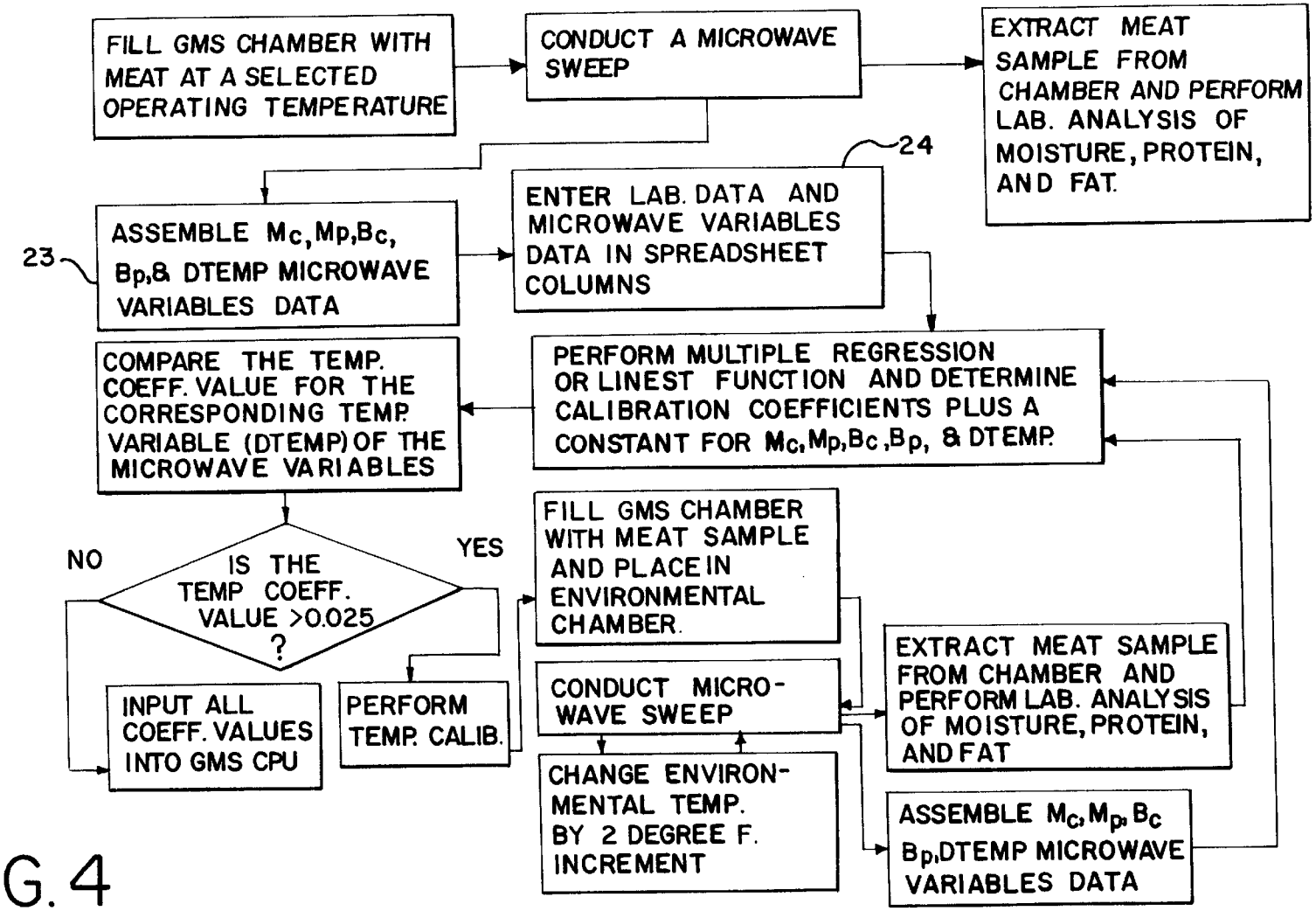
FIG. 4 is a flow chart of the steps taken in accordance with one embodiment of the present invention.

It has been noted that the GMS sensors exhibit minimal sensitivity to pressure and flow factors which means that they can be calibrated in a static mode, namely with no flow in the system. The present invention provides for a method of static calibration of the GMS unit 10. In order to facilitate the understanding of the method of temperature calibration of the present invention, a detailed discussion of the processing steps will follow with reference to the flow chart in FIG. 4.

Figure 3:
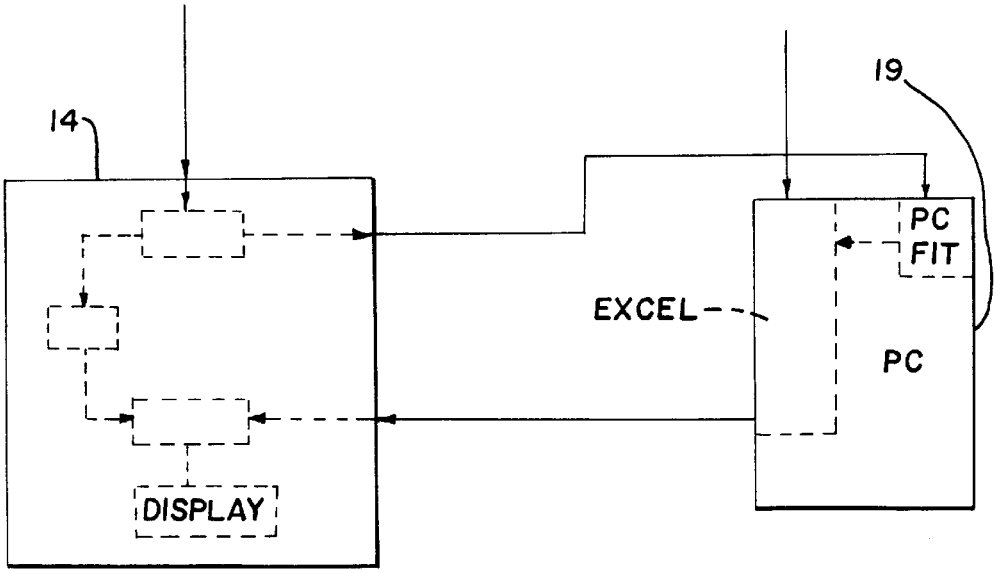
FIG. 3 is a block diagram illustration of the flow of data in implementing the present invention.

First a sample supply of meat is provided in a portion 20 of the GMS unit 10 for microwave signal measurement of the same. While providing the meat sample in the portion 20 of the GMS unit 10, it is important to eliminate any air pockets present, since the air pockets will adversely affect the microwave signal measurements. The next step is to apply a required amount of microwave power to the meat sample and obtain microwave signal sweeps or readings of the meat sample. It is desired, however, to obtain three microwave signal readings of the meat sample. The microwave signal readings are considered "raw" signals as there are no mathematical operations performed on these signals prior to this step. These raw microwave signal readings are then collected by the GMS unit 10 and processed by the CPU 14 and further transmitted to the PC 19. (See FIG. 3).

The CPU 14 and the PC 19 each have a respective data channel circuitry for performing data manipulations on the collected microwave signals. In general, the PC 19 through its data channel circuitry performs the data manipulations on the microwave signal readings that it receives and enables the temperature calibration of the GMS unit 10. It should be noted that the PC 19 is used on a one-time basis in the present invention for calibrating the GMS unit 10, and it does not serve as an integral or permanent component of the apparatus of the invention. The PC 19 effectively functions as a temperature calibrating tool for the GMS unit 10 by providing a set of temperature corrected coefficients for use by the GMS CPU 14 in calculating the above-mentioned meat parameters.

In order to provide the set of coefficients, the PC 19 is utilized to perform a series of data manipulation steps. The first step includes calculating a set of microwave variables data from the collected raw microwave signal readings. These microwave variables data are listed below, wherein each variable is further defined:

$M_c$=Epsilon slope;

$B_c$=Epsilon offset;

$F_c$=Dual Line Intercept;

$M_p$=Tau Slope;

$B_p$=Tau Offset;

DT=Sample temperature in chamber

Epsilon=Dielectric constant that measures the reduction in signal velocity;

Sigma=conductivity or amplitude reduction (dielectric loss factor);

Tau=Molecular relaxation time; and

Temperature=Sample temperature in the chamber.

The calculation of the variables data is performed utilizing the data channel circuitry 23. As part of the data channel circuitry 23, software programs commonly known as LINEFIT or PcFit, may be used. The data channel circuitry of the PC 19 evaluates the microwave signal readings and produces the variables data corresponding to the aforementioned microwave signal sweeps or readings. It should be noted that the GMS CPU 14 also calculates a corresponding set of microwave variables data, through its respective data channel circuitry, that will be used in a final temperature corrected fat content calculation step to be discussed below. In addition to calculating the microwave variables data, the PcFit software program is capable of plotting and storing the variables data for future reference. The calculated variables data are then further operated on in the PC by using the Least Square Means (Y=mx+b) statistical method and performing multiple regression thereon.

In order to perform the multiple regression on the variables data, these data are imported into a spreadsheet data channel circuitry 24, which typically will be of the PC 19. The multiple regression operation performed by the spreadsheet data channel circuitry 24 can be implemented using programs such as those known as EXCEL or StatGraphics and commercially available. In this embodiment, the spreadsheet data channel circuitry receives the variables data in its spreadsheet format and performs an operation on the above-mentioned variables data in order to provide a single set of variables data corresponding to the microwave signal readings of the first meat sample. When, as desired, multiple sweeps of microwave signal readings of the meat sample are made, then the corresponding multiple variables data are averaged to provide an averaged single set of variables data. In any event, the single set of variables data is stored in an appropriate column position of the spreadsheet.

As a next step, the meat sample is extracted from the GMS unit 10 and laboratory analysis is performed thereon for directly determining its meat parameters such as fat content. The meat sample is extracted from a pipeline portion 20 by removal of a pair of antenna plates (not shown) used in the detection of the microwave signals. From the laboratory analysis of the meat sample a series of laboratory proximate data are developed and input into another column of the spreadsheet corresponding to the column position having the single set of variables data therein. This laboratory proximate data of the meat sample correspond to the single set of variables data is stored in the spreadsheet data channel circuitry 24.

The aforementioned steps should be repeated in order to accumulate about thirty sets of microwave variables data with a matching number of laboratory proximate data. A multiple regression is then performed on the microwave variables data and the laboratory proximate data using the LINEST function in the spreadsheet data channel circuitry 24 in order to generate a first set of calibration coefficients. These calibration coefficients can be provided to the CPU 14 of the GMS unit 10 to determine the fat content of a flowing meat supply. However, this determination may not be accurate as the effects of temperature variations in the supply of meat must be taken into account in generating the calibration coefficients.

One of the calibration coefficients generated is a temperature coefficient that corresponds to one of the variables, namely the temperature variable DT calculated in the variables data calculation. This temperature coefficient must be evaluated and compared to a predetermined temperature coefficient value of 0.025. The 0.025 value is significant since typical meat processing applications require an accuracy of +/−0.2% to 0.3% fat content. With a temperature coefficient of 0.025, a change in temperature from 40 to 45 degrees F. will change the % fat measurement by about 0.15%. This can be acceptable in most traditional meat handling applications. In systems where even more accuracy is needed, it is necessary to have a calibration where the temperature coefficient is in the 0.0025 range which will create a 0.05% fat change, with a 40 to 45 degree. F. temperature change.

In accordance with the present invention, the meat flow being handled is exceptionally lean, typically having no more than 1.5% fat, and usually lower fat percentages. Because of these very low fat percentages, the tolerance is very tight. For example, a change of 0.15 percentage units due to a temperature shift represents an accuracy loss of at least 10%. The temperature calibration achieved by the present invention automatically accounts for such fat reading inaccuracies due to normal temperature variations within a meat processing plant.

In the present invention, if the calculated temperature coefficient value is less than 0.025 (or other selected coefficient value), the GMS unit 10 is considered to be calibrated. However, if the temperature coefficient is larger than 0.025, then these additional steps must be performed to calibrate the GMS unit 10 for temperature by adjusting the calibration coefficients generated by the PC including the temperature coefficient. In order to adjust the calibration coefficients, the following steps are implemented.

Initially, a portion of the GMS unit 10 is filled with another supply of meat sample (hereinafter referred to as "the temperature meat sample") and any air pockets are eliminated. The GMS unit 10 is then placed in an environmental chamber (not shown) for enabling the collection of the microwave signal readings within a process temperature range. After placing the GMS unit 10 in the environmental chamber, the temperature is varied in increments of 2 degrees F. across the process temperature range. It is desired that measurements on at least ten 2 degree F. increments be performed. Furthermore, it is desired that at each increment of 2 degrees F. five microwave signal readings be gathered by the GMS unit 10. The microwave signal readings are processed by the CPU 14, and transferred to the PC. The microwave signal readings of the temperature meat sample are transferred to the data channel circuitry 23 for producing the corresponding variables data.

The temperature meat sample is removed from the GMS unit 10 and a predetermined number of laboratory analyses are performed thereon to produce a matching number of laboratory proximate data of the temperature meat sample. The microwave variables data are further provided to the spreadsheet data channel circuitry 24. In the event that the five microwave signal readings are gathered from the temperature meat sample, then an averaging operation is performed on each of the five microwave variables data associated with each of the 2 degree F. increments in order to provide a single set of microwave variables data associated with each 2 degree increment. This operation results in a total of ten single sets of microwave variables data which in turn correspond to the ten laboratory proximate data of the temperature meat sample. The resulting ten temperature meat sample microwave variables data and laboratory proximate data are appended to the previously-mentioned thirty microwave variables data and laboratory proximate data thereby providing a data base in the spread-sheet data channel circuitry 24.

Another multiple regression is performed on the data base using the spreadsheet data channel circuitry 24, and a temperature-adjusted set of calibrated coefficients is generated. Again, the adjusted temperature coefficient is compared to the predetermined temperature coefficient value of 0.025 to make certain that it is less than 0.025. The temperature adjusted set of calibration coefficients is communicated to the CPU 14 of the GMS unit 10, wherein a temperature-corrected meat parameter such as fat content is calculated.

As noted above, the CPU 14 is pre-loaded with an upper limit value corresponding to the maximum allowable fat content. In the illustrated embodiment, this maximum fat content is set at 1.5 weight percent. In the event that the fat content of the flowing supply of meat measured by the temperature calibrated GMS unit 10 exceeds this maximum level, then the GMS unit 10 actuates the diverter valve 15 to redirect the flow of a portion of meat that exceeds such maximum level into a pipeline 21 for further reprocessing. The portions of the flowing supply of meat that do not exceed the 1.5% fat content limit are allowed into the container 22 for final production of a desired meat product. Preferably that meat product satisfies applicable governmental standards for "fat-free" meat products.

It will be understood that the embodiments of the present invention which have been described are illustrative of some of the applications of the principles of the present invention. Various modifications may be made by those skilled in the art without departing from the true spirit and scope of the invention.

We claim:

1. A method of separating lean meat products into multiple groups, at least one group having a fat content in excess of a predetermined low-fat content of about 1.5 weight % of the lean meat, comprising the steps of:

providing a microwave sensor unit having a location at which microwave power is applied;

presenting a supply of lean meat into the microwave sensor unit;

applying microwave power of the microwave sensor unit to the supply of lean meat to generate microwave signal readings of the meat products;

sensing the temperature of the supply of lean meat to generate a temperature signal reading;

transmitting said microwave signal readings and said temperature signal reading to a data processor for the microwave sensor unit;

using the microwave signal readings to determine a fat content value of the supply of meat while applying the temperature signal reading in order to adjust the fat content value according to the temperature of the sensing step, thereby automatically correcting the fat content value output of the microwave sensor unit for variations in temperature of the supply of meat to provide a temperature-corrected fat content value;

comparing the temperature-corrected fat content value derived during said using step with a predetermined low-fat content value; and diverting from the supply of lean meat at least a portion thereof which had been determined during said comparing step to have a fat content in excess of said predetermined low-fat content value.

2. The method of claim 1, wherein said using step function of applying the temperature signal reading.

3. A method of separating lean meat products into multiple flows, at least one flow having a meat parameter content in excess of a predetermined content of the meat parameter including a fat content in excess of about 1.5 weight % of the lean meat, comprising the steps of:

providing a microwave sensor unit having a location at which microwave power is applied;

flowing a supply of lean meat through the microwave sensor unit;

applying microwave power of the microwave sensor unit to the flowing supply of lean meat to generate microwave signal readings of the meat products;

sensing the temperature of the flowing supply of lean meat to generate a temperature signal reading;

transmitting said microwave signal readings and said temperature signal reading to a data processor for the microwave sensor unit;

processing said microwave signal readings and said temperature signal reading together with a preloaded set of temperature calibration coefficients in order to generate temperature-corrected meat parameter content value outputs for the microwave sensor unit for variations in temperature of the flowing supply of lean meat;

comparing the temperature-corrected meat parameter content value output derived during said processing step with a predetermined value for the content of the meat parameter; and diverting from the flowing supply of lean meat a portion thereof which had been determined during said comparing step to have a temperature-corrected meat parameter content value output in excess of said predetermined value for the content of the meat parameter including a fat content in excess of about 1.5 weight % of the lean meat supply.

4. The method of claim 3, wherein said meat parameter content includes a protein content of said flowing supply of lean meat.

5. The method of claim 3, wherein said meat parameter content includes a moisture content of said flowing supply of lean meat.

* * * * *

UNITED STATES PATENT AND TRADEMARK OFFICE

CERTIFICATE OF CORRECTION

PATENT NO. : 6,043,444 
DATED : March 28, 2000
INVENTOR(S) : S. Fred Nutt, Larry C. Gundlach, William T. Paulos and Andrew Milkowski It is certified that error appears in the above-identified patent and that said Letters Patent is hereby corrected as shown below:

Title page,
Under "Attorney, Agent, or Firm", insert a comma -- , -- after "McFarron".

Column 4,
Line 52, delete "1.4%" and insert -- 1.5% --.

Column 6,
Line 17, insert a semicolon -- ; -- after "chamber".

Column 7,
Line 1, delete "This" and insert "These";
Line 2, "sample correspond" should read -- sample, which correspond --;
Line 3, "data is"should read -- data, are --;
Line 32, delete the period after "degree".

Column 9,
Line 17, after "reading" insert -- includes modifying the temperature signal reading in accordance with a temperature calibration procedure --.

Signed and Sealed this

Twenty-fifth Day of September, 2001

*Attest:*

Nicholas P. Godici

NICHOLAS P. GODICI
*Acting Director of the United States Patent and Trademark Office*

*Attesting Officer*